US005738151A

United States Patent [19]

Lee

[11] Patent Number: 5,738,151

[45] Date of Patent: Apr. 14, 1998

[54] SEAM LOOP FORMATION DEVICE AND METHOD OF OPERATION

[75] Inventor: Henry J. Lee, Greenville, S.C.

[73] Assignee: Asten, Inc., Charleston, S.C.

[21] Appl. No.: 696,055

[22] Filed: Aug. 13, 1996

[51] Int. Cl.[6] ..... D03D 41/00; D03J 1/14

[52] U.S. Cl. ..... 139/383 AA

[58] Field of Search ..... 139/383 AA; 28/141

[56] References Cited

U.S. PATENT DOCUMENTS

| | | | |
|---|---|---|---|
| 4,410,015 | 10/1983 | Koller et al. . | |
| 4,572,247 | 2/1986 | Speich . | |
| 4,985,970 | 1/1991 | Krenkel et al. . | |
| 5,027,483 | 7/1991 | Anderson | 139/383 AA |
| 5,092,373 | 3/1992 | Lee . | |
| 5,103,874 | 4/1992 | Lee . | |
| 5,117,542 | 6/1992 | Krenkel et al. . | |
| 5,148,838 | 9/1992 | Lee . | |
| 5,390,708 | 2/1995 | Kuster et al. | 139/383 AA |

FOREIGN PATENT DOCUMENTS

| | | | |
|---|---|---|---|
| 0 536 899 | 9/1992 | European Pat. Off. | 139/383 AA |

*Primary Examiner*—Andy Falik

*Attorney, Agent, or Firm*—Volpe and Koenig, PC

[57] ABSTRACT

A shed formation device with a frame assembly having at least two harnesses mounted for movement in the frame. Each harness includes a plurality of heddles through which CMD yarns are passed. The existing cross machine direction (CMD) yarns of the fabric pass over an out-feed bar mounted to the frame assembly as they exit the heddles. A replacement CMD yarn supply provides replacement CMD yarns to the heddles for reweaving with the machine direction (MD) yarns to form seam loops and finished fabric ends. The replacement CMD yarns pass over an in-feed bar, mounted to the frame assembly, prior to passing through the heddles. The harnesses are manipulated to form an unweaving shed in the existing CMD yarns and re-weaving shed in the replacement CMD yarns. Retractable expansion forks assist the unweaving and reweaving of the MD yarns. A leasing device captures MD yarns from the unweaving shed and releases them into the reweaving shed to form seam loops and finished ends.

11 Claims, 7 Drawing Sheets

SEAM LOOP FORMATION DEVICE AND METHOD OF OPERATION

BACKGROUND OF THE INVENTION

1. Field of the Invention

The present invention relates to a device for use in conjunction with automated seaming of papermaking fabrics. More particularly, the present invention provides a weave shed formation device for unweaving and reweaving machine direction yarns to form seaming loops. Most particularly, the present invention is directed to a weave shed formation apparatus and method for constructing a seam in a papermaking fabric having multiple, stacked, machine direction yarns.

2. Description of the Prior Art

Papermaking fabrics are used to transport a continuous paper web through the papermaking machine as the paper sheet is being manufactured. Papermaking machines generally are comprised of three sections, forming, pressing, and drying, with each section requiring a fabric having different characteristics.

Papermaking fabrics are configured as endless belts for use on the papermaking equipment. These endless belts are between fifteen to forty feet wide and one hundred and fifty to three hundred feet long. Although weaving techniques are available to weave endless fabrics, there are practical limitations on the overall size for endless woven fabrics. Additionally, certain sections of the papermaking equipment are not designed to facilitate the installation of an endless fabric. Typically, in the dryer and press sections, flat woven fabrics are supplied having opposing ends which are seamed together during installation. A variety of seaming techniques are known in the art. One conventional method is to form the machine direction yarns on each end of the fabric into a series of loops. The loops of the respective fabric ends are interleaved to define a channel through which a pintle is inserted to join the fabric ends.

Until the mid-1980s, the insertion-type seam loops were prepared manually by reweaving or resplicing the machine directions yarns into their respective fabric ends to form the loops. Preparation of this type of insertion-type seam is described in U.S. Pat. Nos. 4,026,331; 4,438,789; 4,469,142; 4,846,231; 4,824,525; 4,883,096 and 5,148,838.

In order to reduce cost, a greater emphasis has placed on automating the seam loop formation process. One example of an automated seaming machine to manufacture an insertion-type seam is shown in U.S. Pat. No. 4,985,970. The '970 seaming machine holds both fabric ends and reweaves the yarns about a central wire or wire helices forming an insertion-type seam. While this equipment has proven effective in certain applications, the development of new fabric styles creates the need for new seaming methods and apparatus.

SUMMARY OF THE INVENTION

The invention is directed to a shed formation device for forming seam loops and finished ends on a fabric having interwoven machine direction (MD) and cross machine direction (CMD) yarns by reweaving the MD yarns, comprising a frame assembly having at least two movable harnesses, each having a plurality of heddles that receive CMD yarns, an out-feed bar positioned adjacent the heddles so that CMD yarns exiting the heddles pass over the out-feed bar, an in-feed bar positioned adjacent the heddles so that CMD yarns pass over the in-feed bar prior to passing through the heddles, means for moving the harnesses to form shed openings, spreader means for expanding shed openings, and means for manipulating the MD yarns to form seam loops and finished ends.

DESCRIPTION OF TEE PREFERRED EMBODIMENT

Figure 1:
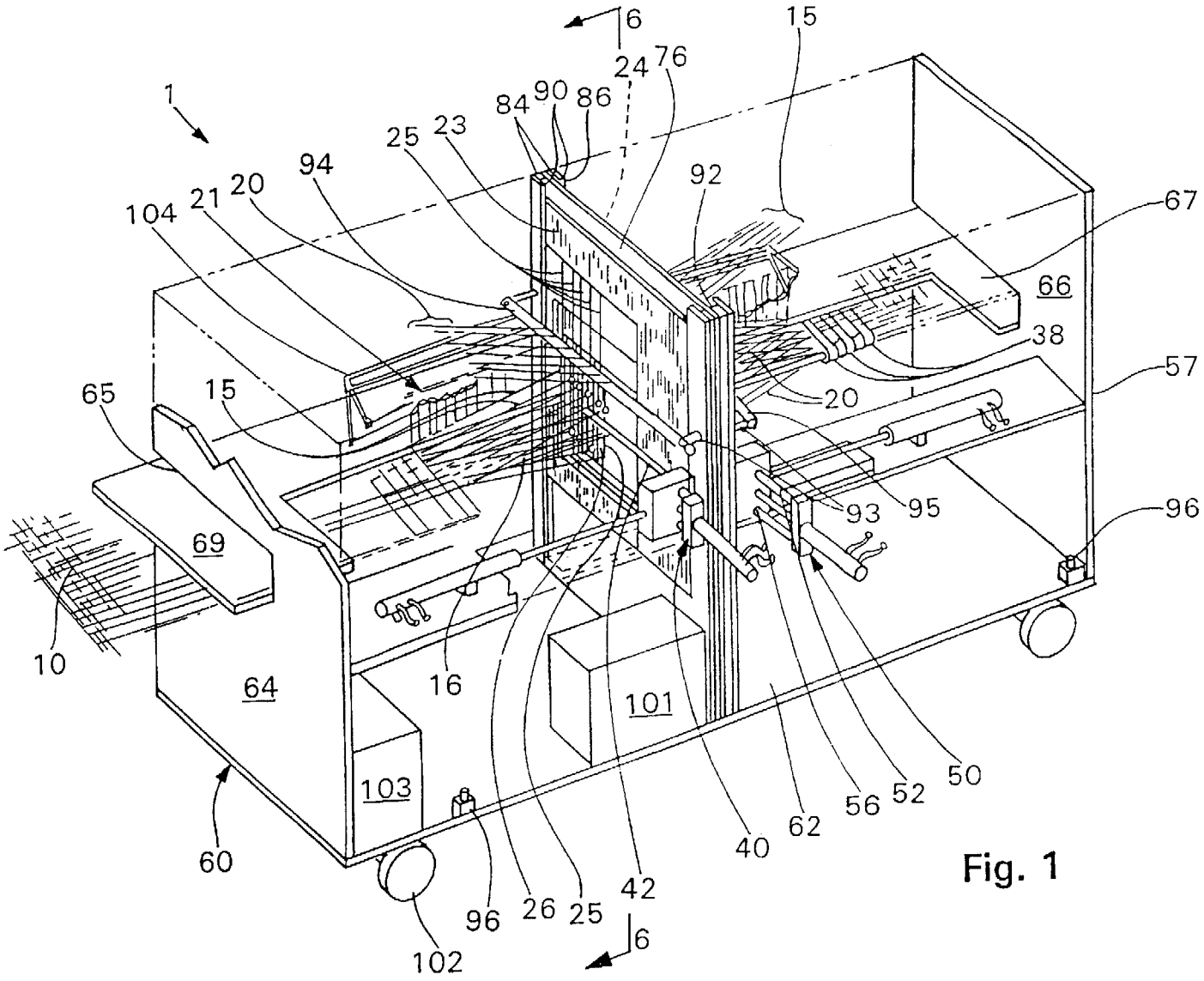
FIG. 1 is a perspective view of a shed formation device in accordance with the preferred embodiment of the present invention.

The present invention will be described with reference to the drawing figures wherein like numerals indicate like elements throughout.

FIG. 1 illustrates one form of a twin shed formation device 1 for forming seaming loops and finished ends in multi-layer fabrics. The device 1 is comprised of a frame 60 having a base 62 with vertical sides 64 and 66, and a center support 76. The sides 64 and 66 have respective horizontal slots 65 and 67, preferably formed at a medial position. Support shelf 69 is mounted through the slots 65 and 67. Preferably, the shed formation device 1 is moveable, such as by wheels 102, for progressive movement along the edge of a fabric 10 during seam loop formation. In the preferred embodiment, the wheels 102 are driven by a motor 103.

Figure 2:
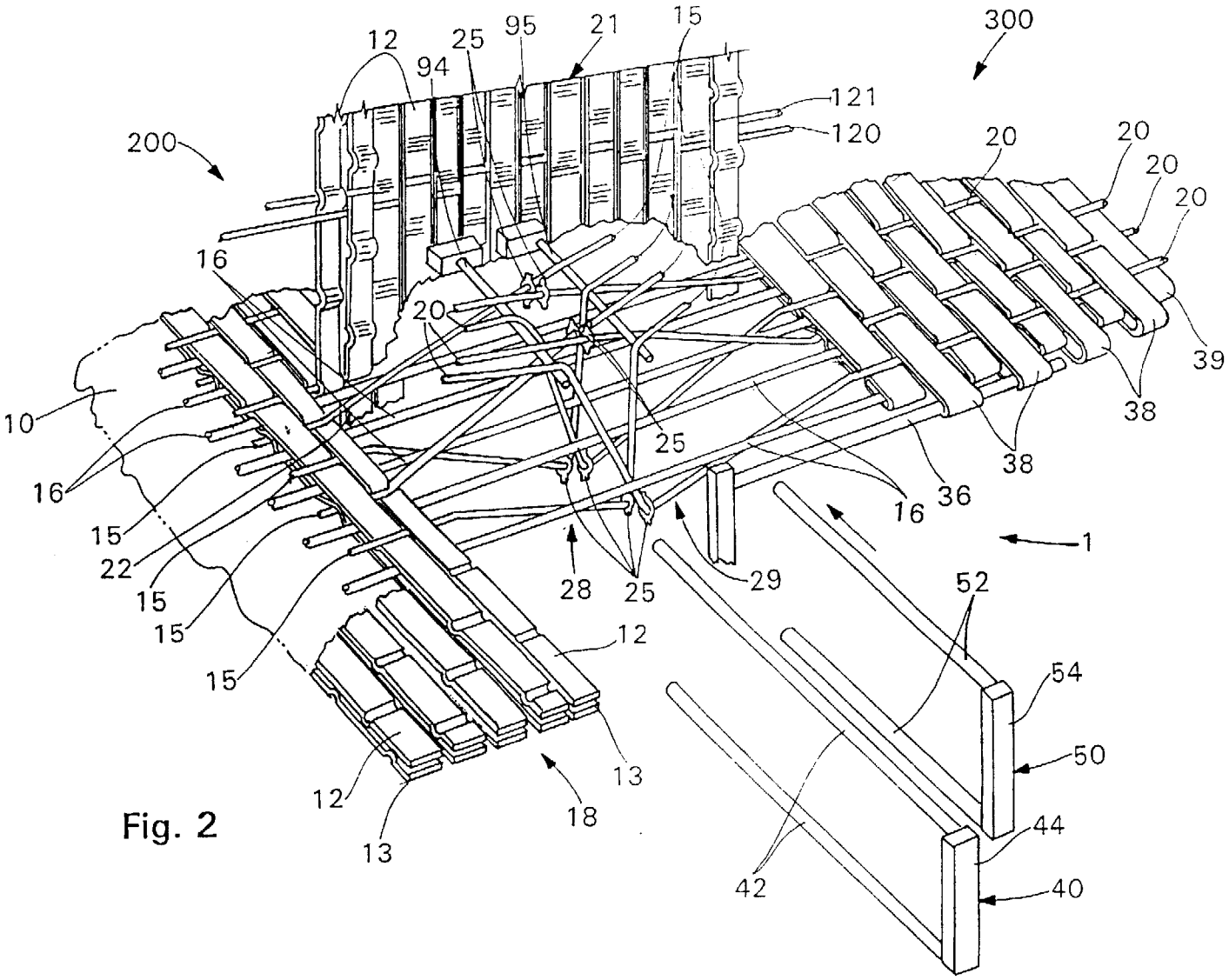
FIG. 2 is a simplified perspective view of a fabric end being provided with seam loops in accordance with the present invention.

The fabric 10 as shown in FIG. 2, has two layers of stacked machine direction yarns (hereafter "MD" yarns), denoted as top layer MD yarns 12 and bottom layer MD yarns 13, and alternating cross machine direction yarns (hereafter "CMD" yarns) 15, 16. The first series of CMD binds yarns 15 are interwoven with the MD yarns 12 and 13, CMD stuffer yarns 16 are woven between MD yarns 12 and 13 and do not pass to the outer surfaces of the fabric 10. Fabrics having a construction of this type are described in U.S. Pat. No. 5,148,838, which is incorporated herein by reference as if fully set forth.

During seaming of the fabric 10, the existing CMD binder yarns 15 are replaced with new replacement CMD binder yarns 20. The existing CMD binder yarns 15 are threaded through the eyes 26 of heddles 25 and directed towards the reweaving side 300 of the fabric 10. The existing CMD binder yarns 15 pass over an out-feed bar 95 and are spooled by a take up device, not shown. The take-up device can be any spooling mechanism as is known in the art.

The new replacement CMD binder yarns 20 are fed in toward the heddles 25 over an in-feed bar 94. The replacement CMD binder yarns are supplied by spool or roll, not shown. The in-feed bar 94 is mounted on the unweaving side 200 of the center support 76 above the cutout 78 with stand offs 93. The out-feed bar 95 is similarly mounted on the reweaving side 300 of the center support 76. The in-feed bar 94 and out-feed bar 95 redirect the existing CMD binder yarns 15 and new replacement CMD binder yarns 20 away from the unweaving and reweaving sheds 28 and 29. By redirecting the binder yarns, the unweaving and reweaving sheds can function without obstruction of the sheds.

As more clearly shown in FIG. 2, the removal of CMD yarns 15 and 16 from the end of the fabric 10 forms a fringe 18 of upper and lower MD yarns 12 and 13. The removal of CMD yarns 15 and 16 is performed either manually or mechanically before insertion of fabric 10 into the device 1. Manual stripping is accomplished by pulling out of the CMD yarns 15 and 16 by hand from the unfinished end of the fabric 10 a certain distance into the fabric 10. The upper fringe MD yarns 12 are moved into an upper leasing device 104, see FIGS. 1 and 6 through 8, the process of which will be discussed in greater detail later herein. A mechanical gripper arm, not shown, as is known in the art, may be used for movement of the upper fringe MD yarns 12. Alternatively, the upper fringe MD yarns 12 may be moved upward by brushes or pneumatic means as known in the art. The upper fringe MD yarns 12 are maintained in position by lease threads, 120 and 121, to form the upper lease fringe 21. The lower MD yarns 13 are moved downwardly and held in lower leasing device 105, FIG. 6, to form the lower lease fringe 22, not shown. The removal of lower MD yarns 13 frees up the areas for the subsequent reweaving of the upper fringe MD yarns 12.

The heddles 25, in FIG. 2, move to form an unweaving shed 28 and a reweaving shed 29. Each pair of heddles 25 moves as a unit up and down in conjunction with one another. The new replacement CMD binder yarns 20 pass through heddles paired with each respective existing CMD binder yarn 15 and are rewoven into the fabric on the reweaving side 300. In an alternate embodiment, each respective pair consisting of an existing CMD binder yarn 15 and a new replacement CMD binder yarn 20 may share the same heddle 25.

Figure 3:
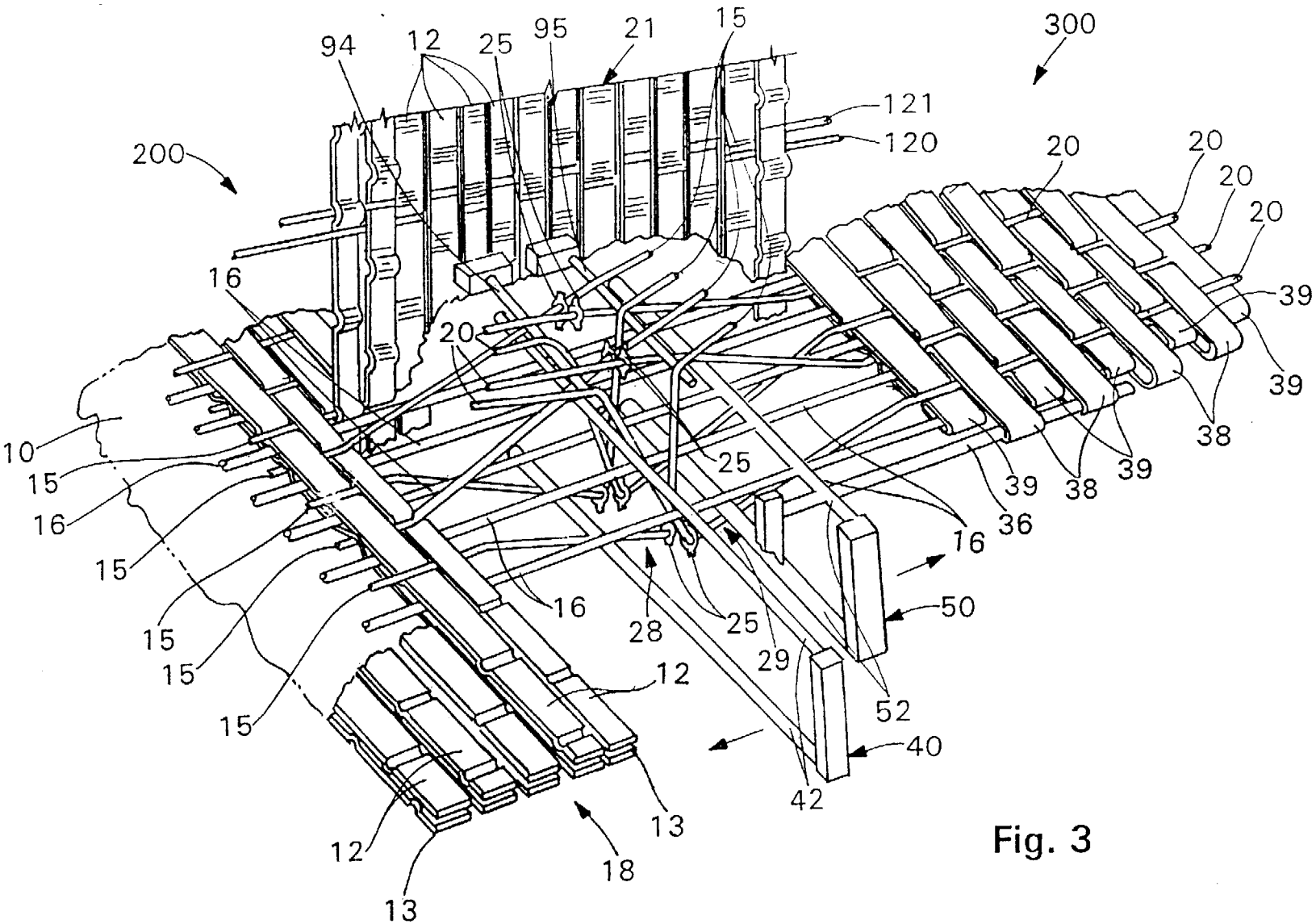
FIG. 3 shows the movement of the shed expansion forks of FIG. 2 into the shed openings.
Figure 4:
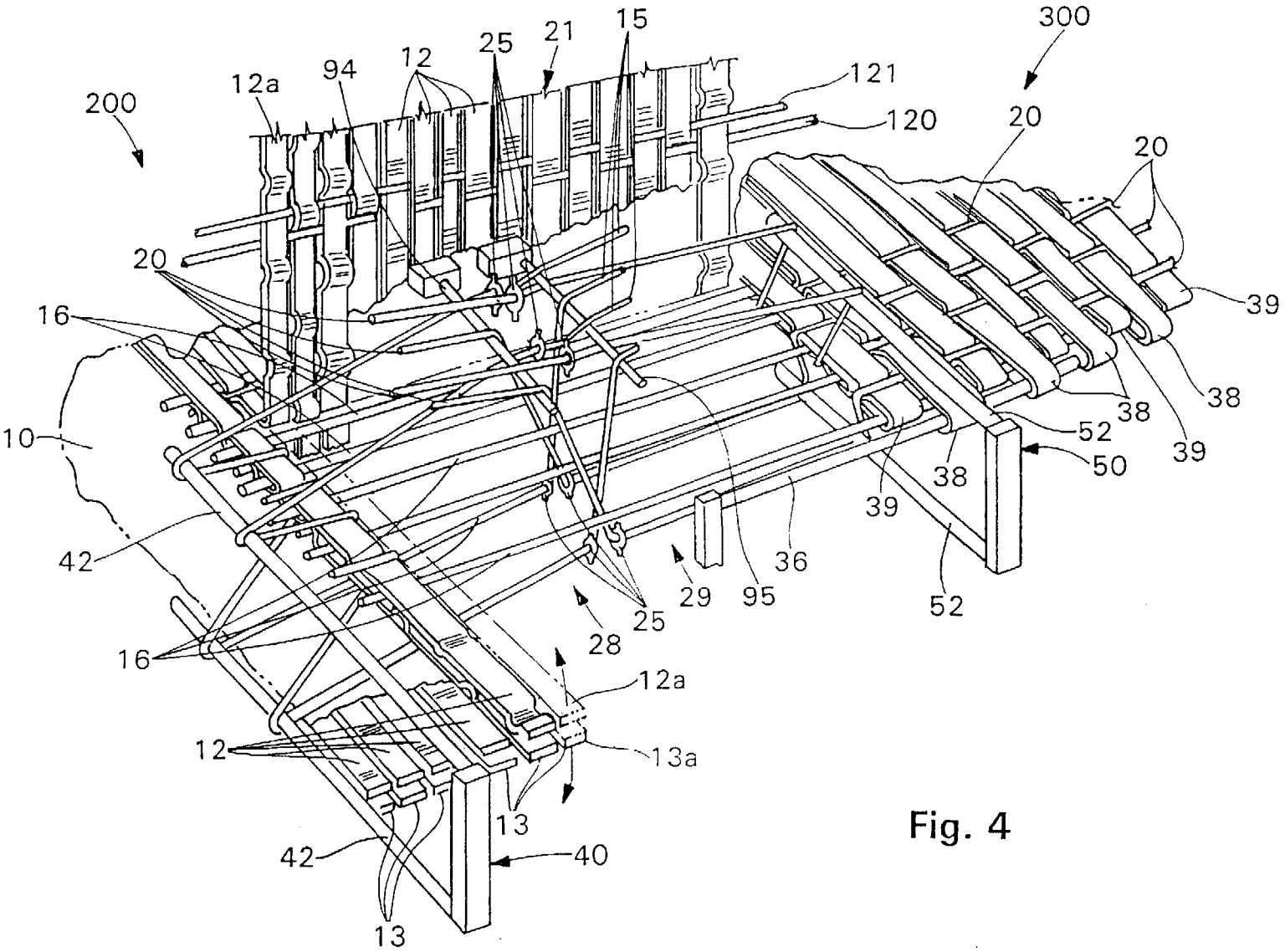
FIG. 4 shows the expanded shed openings formed by outward movement of the expansion forks of FIG. 3 and the unweaving of the MD yarns.
Figure 5:
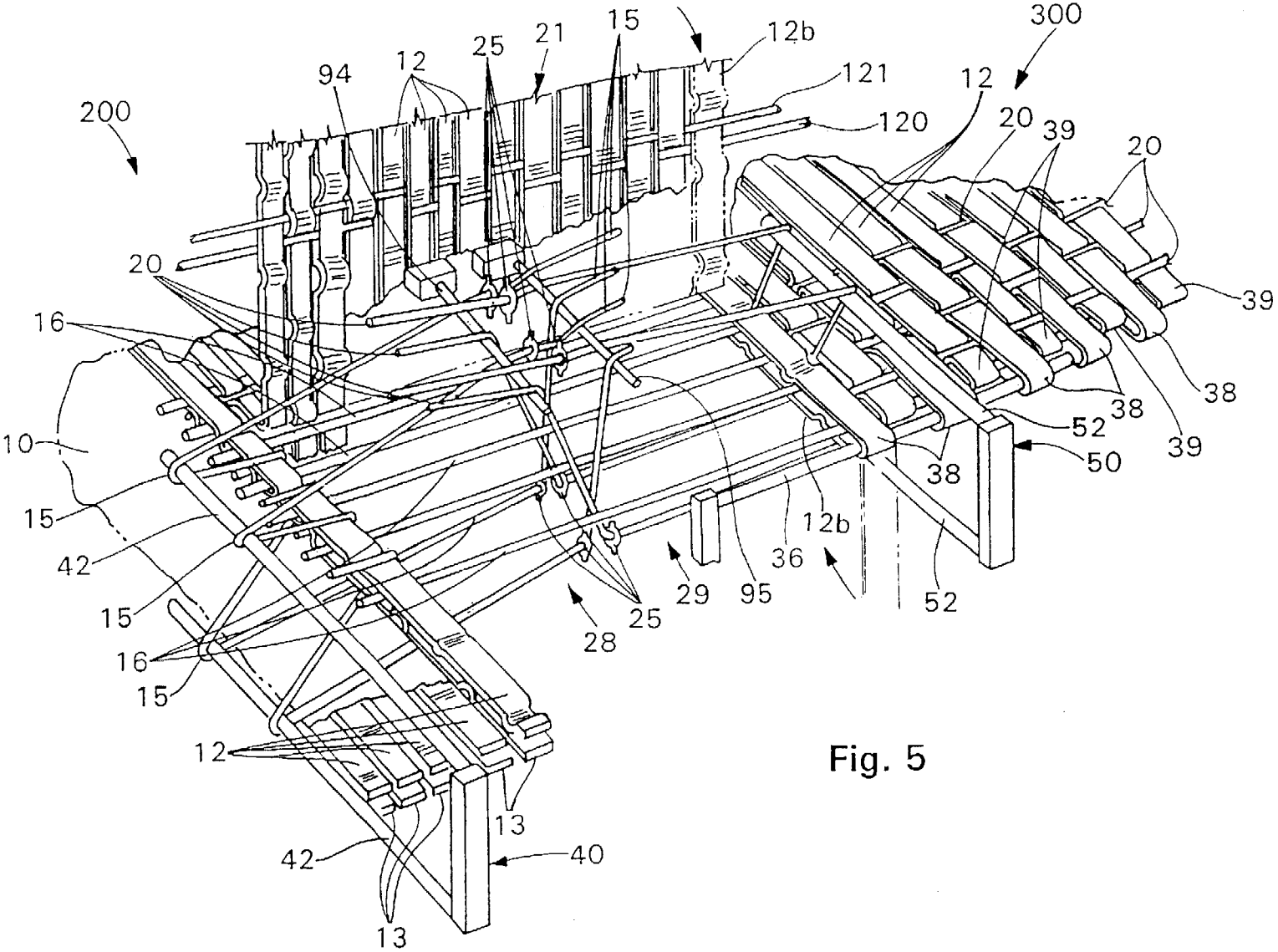
FIG. 5 is a view similar to FIG. 4 showing the sequential formation of a seaming loop from a MD yarn.

Referring to FIGS. 3 through 5, there are sequential views illustrating: (a) the insertion of unweaving and reweaving shed expansion forks 40 and 50 into the unweaving and reweaving angular shed openings, 28 and 29; (b) the creation of an over expanded shed by the expansion forks 40 and 50 and the unweaving of the upper and lower MD yarns 12*a* and 13*a*; and (c) the reweaving of an upper MD yarn 12*b* to form a seaming loop 38 and finished end 39. FIG. 3 illustrates the insertion of the unweaving shed expansion fork 40 and the reweaving shed expansion fork 50 into the respective angular shed openings 28 and 29 respectively.

In FIG. 4, the unweaving and reweaving shed expansion forks 40 and 50 have been moved outward from their original position in the angular shed openings 28 and 29 to form expanded rectangular shed openings. Only the existing CMD binder yarns 15 and new replacement CMD binder yarns 20 are affected by the expansion forks 40 and 50. The CMD stuffer yarns 16 remain in the center of the shed openings. Upper MD yarn 12*a* is removed from the expanded shed opening by rotating it from the horizontal plane of the fabric 10 into a relative vertical plane. The upper MD yarn 12*a* is rotated out of the horizontal plane by a series of brushes or by pneumatic means which are known in the art. The upper MD yarn 12*a* is then captured by end leasing threads 120 and 121 of the upper leasing device 104, FIG. 4, and held in its proper position and sequence in upper lease fringe 21.

Referring to FIG. 4, lower MD yarn 13*a* is moved oppositely and maintained in its proper position and sequence by the lower leasing device 105 in the lower lease fringe 22, not shown. The removal and retention of the lower MD yarn 13*a* mirrors the removal and retention of the upper MD yarn 12*a*. Because the stuffer CMD yarns 16 pass between the upper and lower MD yarns 12 and 13, their positions remain unchanged.

In FIG. 5, the unweaving and reweaving sheds 28 and 29 are in the expanded shed configuration. To form a looped end, the last yarn 12*b* from the upper lease fringe 21 is released by end leasing threads 120 and 121 and moved through the reweaving shed opening 29 and around a loop forming wire 36. The yarn 12*b* is folded back underneath the fabric 10 in the space left by the removal of the corresponding lower MD yarns 13.

To form a finished end 39, the loop forming wire 36 is rotated or moved away from the horizontal plane of the fabric 10. Once finished end 39 is formed, the loop forming wire is moved back into position to form the next loop 38. The end of upper MD yarn 12*b* is folded back underneath the CMD stuffer yarns 16, which act as a guide to maintain the correct strip density and end placement of the upper MD yarn 12*b* as it is rewoven to form a next loop 38. The crimps in the MD yarns also help in guiding placement of the fabric 10. In the preferred embodiment, the loops 38 and finished ends 39 alternate in the ratio of one loop for every one finished end. Alternatively, different ratios such as two loops for every finished end may be used.

Although the loop formation illustrated shows only the upper MD yarn 12*b* being used to form the loop, this process alternatively can be done with lower MD yarns 13. In practice, both the upper and lower MD yarns 12 and 13 require manipulation so that the rewoven ends of adjacent MD yarns are staggered. The unweaving and reweaving of the MD yarns 12 and 13 can occur simultaneously, because they share the same shedding motion.

The unweaving and reweaving shed expansion forks 40 and 50 are then moved back to the position shown in FIG. 3 and are removed from the unweaving and reweaving shed openings 28 and 29. The heddles 25 are moved in accordance with the weave shed repeat pattern, to lock the finished seam loop 38 in position.

The process is then repeated by inserting the unweaving and reweaving shed expansion forks 40 and 50 into the next shed openings, expanding the sheds, unweaving the next released upper and lower MD yarns 12 and 13, capturing the ends in the leasing device, releasing the last MD yarns from the leasing device and transferring it to the expanded reweaving shed opening where it is positioned on the CMD stuffer yarn 16 to form a finished end 39. After the upper MD yarns 12 are formed into finished ends and loops, the lower MD yarns 13 are trimmed away from the fabric 10 at the reweaving side 300.

Figure 6:
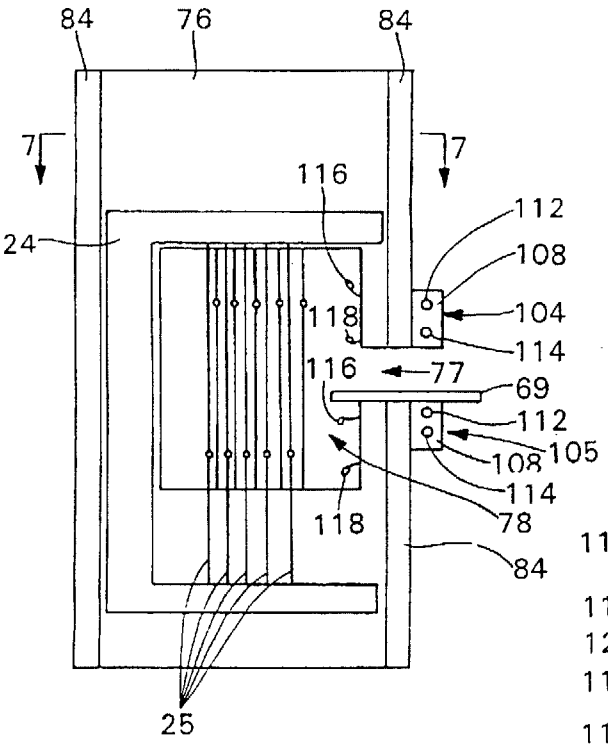
FIG. 6 is a view taken along line 6—6 in FIG. 1.

The center support 76, shown in detail in FIG. 6, is formed with cutout 78 through its center. A horizontal slot 77 connects the outside edge of the center support 76 with the cutout 78. The slot 77 is in alignment with the slots 65 and 67 and, together, they provide a path for the end of the fabric 10 to move along the shelf and through the center cutout 78.

C-shaped harnesses 23 and 24 are slidably mounted on each side of the center support 76. The sides of the C-shaped harnesses frames 23 and 24 are captured in slots 90 and 92 formed from spacers 84 and vertical caps 86 mounted along the outside vertical edges of the center support 76. The heddles 25 are mounted in the C-shaped harnesses 23 and 24 in an aligned position with the cutout 78 in the center support 76.

As shown in FIG. 2, the unweaving shed expansion fork 40 is made from a support 44 with two attached horizontal tines 42 which extend toward the unweaving shed opening 28. As further shown in FIG. 7, the tines 42 are slidably disposed in apertures defined in a sliding block 47. A linear pneumatic actuator rod 48 is attached to the opposite side of the support 44 from the tines 42. The actuator rod 48 extends through an aperture 46 in the support 44 and is attached to the sliding block 47. When the actuator 48 is extended, the tines 42 of the expansion fork 40 are pulled away from the unweaving shed opening 28. When the actuator 48 is retracted, the tines 42 are moved into the unweaving shed opening 28. The support 44 is mounted on a linear slide table 75, supported by the shelf 71. A linear pneumatic actuator 80, attached to the shelf 71 by supports 72 and 73, is connected to the support 44 and moves the expansion fork 40 in a direction parallel to the fabric edge in order to form the over expanded shed opening.

Figure 7:
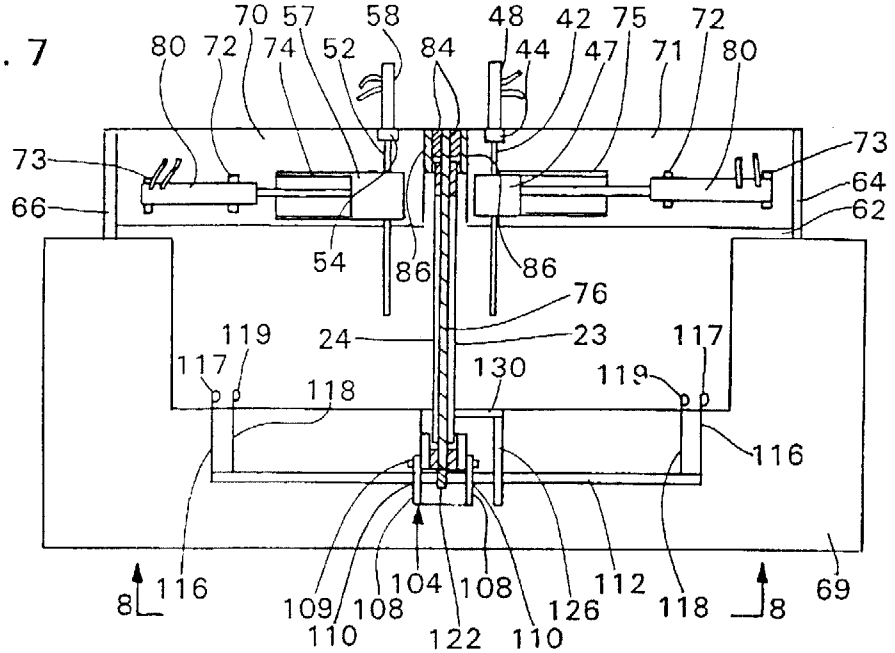
FIG. 7 is a view taken along line 7—7 in FIG. 6.
Figure 8:
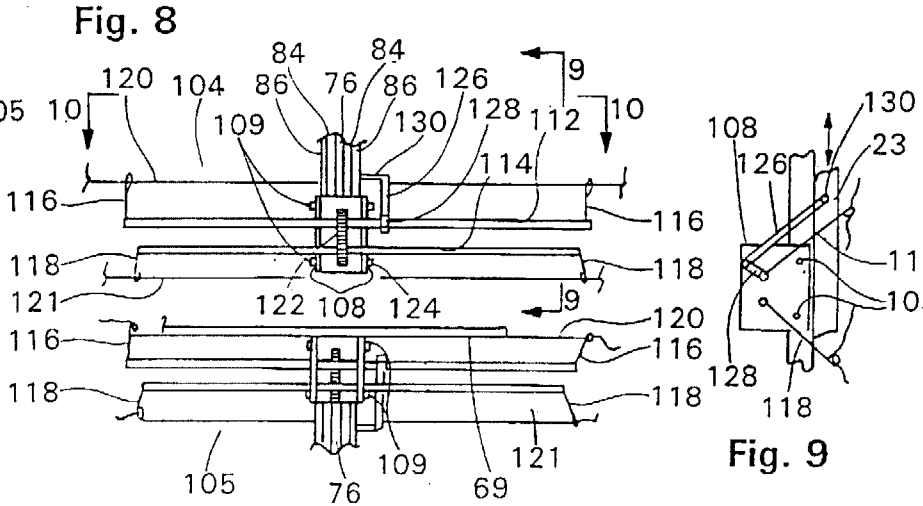
FIG. 8 is a view taken along line 8—8 in FIG. 7.
Figure 9:
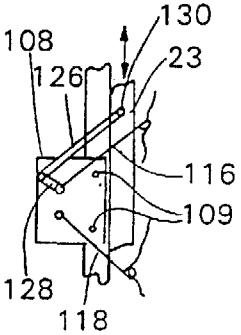
FIG. 9 is a view taken along line 9—9 FIG. 8.

The reweaving shed expansion fork 50 is mounted above shelf 70 in a similar manner to the unweaving shed expansion fork 40. As more clearly shown in FIG. 2, the reweaving shed expansion fork 50 is comprised of a support 54 having two attached tines 52 which extend toward the reweaving shed opening 29. Referring to FIG. 7, the tines 52 are slidably disposed in apertures defined in a sliding block 57. A linear pneumatic actuator rod 58 is attached to the opposite side of the support 54 from the tines 52. The actuator rod extends through an aperture 56 in the support 54 and attaches to the sliding block 57. When the actuator 58 is extended, the tines 52 are moved away from the reweaving shed opening. When the actuator 58 is retracted, the tines 52 are moved into the reweaving shed opening 29.

The sliding block 57 is mounted to a linear slide table 74, supported by the shelf 70. A linear pneumatic actuator 80, mounted on supports 72 and 73, moves the sliding block 57 with the shed expansion fork 50 in a direction parallel to the fabric edge in order to form the expanded reweaving shed opening 29.

A controller, shown in FIG. 1, controls the timing of the motion of the shed expansion forks 40 and 50 in conjunction with the movement of the C-shaped harnesses 23 and 24. The movement of the twin shed formation device 1 along the fabric edge is also regulated by the controller. Two push buttons 96, located at along the opposite sides of the base 62, are used to signal the controller to change sheds.

As further shown in FIG. 1, fixed to the base 62 is a drive system 101 which moves the C-shaped harnesses 23 and 24 up and down in a simple alternating pattern. The drive system 101 is comprised of a DC motor with a cam system which moves the C-shaped harnesses 23 and 24 in a vertical plane.

The upper and lower leasing devices 104 and 105 are shown in detail in FIGS. 7–10. Each upper and lower leasing devices 104, 105 is comprised of two upper and lower rods 112 and 114 which are disposed in apertures 110 in plates 108. The plates 108 are mounted with fasteners 109 on each side of the center support 76 above the slot 77 and below the cloth support shelf 69. intermeshing gears 122 and 124 are mounted on rods 112 and 114 respectively at a position between the two plates 108. The gears 122 and 124 have a 1:1 ratio. An arm 128 is fixed to the upper rod 112 at a position adjacent to the center support 76. The arm is attached by a linkage 126 to a pivot post 130, affixed to the C-shaped harness 23. As the C-shaped harness 23 moves up and down, the upper rod 112 rotates approximately 90°. This rotation translates to an opposite direction rotation of the lower rod 114 by the gears 122 and 124.

Affixed to the ends of the upper and lower rods 112 and are guide wires 116 and 118. The guide wires 116 and 118 are directed toward the interior of the twin shed formation device 1 to a position in line with the position of the upper and lower lease fringes 21 and 22. Loops 117 and 119 are formed at the ends of guide wires 116 and 118 respectively. A continuous lease string 120 is fed through the loops 117 for each upper rod 112 and a second continuous lease string 121 is fed through the loops 119 for each lower rod 114.

Figure 10:
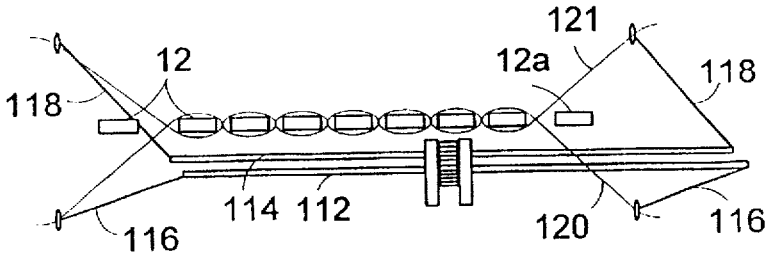
FIG. 10 is a view taken along line 10—10 in FIG. 8.

Referring to FIG. 10, as the shed changes and the C-shaped harness 23 moves up or down, the guide wires 116 and 118 cross positions and hold the next released upper MD yarns **12*a* in position. The same movement at the opposing end of the guide wires 116 and 118 release the last upper fringe MD yarns 12 for reweaving to form next loops 38 or finished ends 39. The lower leasing device 105** operates in the same manner.

The preferred embodiment of the twin shed formation device 1 has been described for semi-automated seam loop reweaving; however, those skilled in the art will recognize that the invention is useful for automated seam loop reweaving equipment. It will be appreciated that various modifications can be implemented to the above described embodiment, which should be considered illustrative, without departing from the scope of the invention which is defined by the claims which follow.

I claim:

1. A shed formation device for forming seam loops and seam finished ends on an end of an open ended fabric which is positioned adjacent the shed formation device, the fabric having cross machine direction (CMD) yarns interwoven with machine direction (MD) yarns, each of the MD yarns having a portion in a fabric body and a portion in a fabric fringe at the end of the fabric, the shed formation device comprising:

a frame member;

at least two movable harnesses connected to the frame member, each harness having a plurality of heddles for receiving CMD yarns;

means for moving the harnesses to form shed openings;

spreader means for expanding the shed openings;

means for unweaving a portion of each MD yarn adjacent the fabric fringe;

leasing means for temporarily retaining a portion of the unwoven MD yarns;

means for removing select CMD yarns from the fabric body adjacent the fabric fringe;

means for selectively presenting additional CMD yarns to the fabric body adjacent to the fabric fringe; and means for weaving the additional CMD yarns with selected MD yarns to selectively form seam loops and seam finished ends which will intermesh with seam loops and seam finished ends on a second end of the fabric.

2. The device according to claim 1 wherein the means for removing select CMD yarns includes an out-feed bar positioned adjacent the heddles whereby the removed CMD yarns pass through the heddles and over the out-feed bar.

3. The device according to claim 1 wherein the means for adding select CMD yarns includes an in-feed bar positioned adjacent the heddles whereby the additional CMD yarns pass over the in-feed bar and through the heddles.

4. The device according to claim 1 further comprising:

a plurality of wheels supporting the device; and motor means for driving movement of the wheels to facilitate movement of the device along the adjacent end the fabric.

5. The device according to claim 1 further comprising:

a support shelf aligned with the frame member for guiding longitudinal movement of the fabric.

6. A shed formation device for forming seam loops and seam finished ends on an end of an open ended fabric which is positioned adjacent the shed formation device, the fabric having cross machine direction (CMD) yarns interwoven with machine direction (MD) yarns, each of the MD yarns having a portion in a fabric body and a portion in a fabric fringe at the end of the fabric, the shed formation device comprising:

a) a frame member;

b) at least two movable harnesses connected to the frame member, each harness having a plurality of heddles for receiving CMD yarns;

c) means for moving the harnesses to form shed openings;

d) spreader means for expanding the shed openings;

e) means for unweaving a portion of each MD yarn adjacent the fabric fringe;

f) means for removing select CMD yarns from the fabric body adjacent the fabric fringe;

g) means for selectively adding CMD yarns to the fabric body adjacent to the fabric fringe;

h) leasing means for temporarily retaining a portion of the unwoven MD yarns comprising:

i. a mounting plate attached to the frame member, the plate having a plurality of rod receiving apertures disposed thereon;

ii. an upper rod, having first and second ends, interposed through one of the apertures and attached to one of the harnesses for movement of the upper rod in conjunction with movement of that harness;

iii. a lower rod, having first and second ends, interposed through another of the apertures whereby it is positioned away from and generally parallel to the upper rod;

iv. a guide extending from each end of each rod;

v. a first string means fed through the guides of the upper rod;

vi. a second string means fed through the guides of the lower rod; and vii. intermeshing gear means for guiding reciprocal movement of the lower rod in relation to the upper rod so as to capture unwoven MD yarns and release MD yarns to be rewoven; and i) means for reweaving the unwoven and fringe portions of selected MD yarns with the added CMD yarns to selectively form seam loops and seam finished ends which will intermesh with seam loops and seam finished ends on a second end of the fabric.

7. The device according to claim 6 wherein the first and second string means are part of a single string.

8. device for manipulating machine direction (MD) yarns as they are passed through a shed formation device for unweaving and reweaving, the device comprising:

a mounting plate adapted to be attached to the shed formation device, the plate having a plurality of rod receiving apertures disposed thereon;

an upper rod, having first and second ends, interposed through one of the apertures and adapted to be attached to a harness of the shed formation device for movement of the upper rod in conjunction with movement of the harness;

a lower rod, having first and second ends, interposed through another of the apertures whereby it is positioned away from and generally parallel to the upper rod;

a guide extending from each end of each rod;

a first string means fed through the guides of the upper rod;

a second string means fed through the guides of the lower rod; and intermeshing gear means for guiding reciprocal movement of the lower rod in relation to the upper rod so as to capture unwoven MD yarns and release MD yarns to be rewoven.

9. The device according to claim 8 wherein the first and second string means are part of a single string.

10. A method for forming seam loops and seam finished ends on an end of an open ended fabric having a fabric body and a fabric fringe composed of machine direction (MD) and cross machine direction (CMD) yarns, the method comprising the steps of:

positioning the fabric in a shed formation device;

forming unweaving and reweaving sheds;

inserting shed expansion means in the unweaving and reweaving sheds;

expanding the unweaving and reweaving sheds;

unweaving a portion of a select MD yarn adjacent the fabric fringe;

removing select CMD yarns from the fabric body adjacent the fabric fringe;

providing additional CMD yarns to the fabric body adjacent the fabric fringe;

weaving the additional CMD yarns with a select MD yarn to selectively form the seam loop or seam finished end.

11. The method of claim 10 further comprising the step of providing a yarn leasing means for temporarily retaining a portion of the unwoven MD yarns.

* * * * *

UNITED STATES PATENT AND TRADEMARK OFFICE

CERTIFICATE OF CORRECTION

PATENT NO. : 5,738,151

DATED : April 14, 1998

INVENTOR(S) : Henry J. Lee

It is certified that error appears in the above-indentified patent and that said Letters Patent is hereby corrected as shown below:

IN THE ABSTRACT

On line 4 of the Abstract, delete "CMD" and insert --cross machine direction (CMD)-- therefor.

On line 5 of the Abstract, delete "(CMD)" and insert --CMD-- therefor.

In column 5, on line 62, insert --128-- after the word "arm".

In column 6, on line 1, insert --114-- after the word "and".

Signed and Sealed this

Seventh Day of July, 1998

Bruce Lehman

*Attest:*

BRUCE LEHMAN

*Attesting Officer*

*Commissioner of Patents and Trademarks*